US008459024B2

(12) United States Patent
Koch

(10) Patent No.: US 8,459,024 B2
(45) Date of Patent: Jun. 11, 2013

(54) TURBOCHARGER COMPRISING A COOLING DEVICE AND AN OIL SUPPLY PIPE

(75) Inventor: Achim Koch, Tegernheim (DE)

(73) Assignee: Continental Automotive GmbH, Hannover (DE)

( * ) Notice: Subject to any disclaimer, the term of this patent is extended or adjusted under 35 U.S.C. 154(b) by 591 days.

(21) Appl. No.: 12/671,413

(22) PCT Filed: Jul. 25, 2008

(86) PCT No.: PCT/EP2008/059814

§ 371 (c)(1),
(2), (4) Date: Jan. 29, 2010

(87) PCT Pub. No.: WO2009/019153

PCT Pub. Date: Feb. 12, 2009

(65) Prior Publication Data

US 2010/0296920 A1 Nov. 25, 2010

(30) Foreign Application Priority Data

Aug. 6, 2007 (DE) ..... 10 2007 036 995

(51) Int. Cl.
*F02B 33/44* (2006.01)

(52) U.S. Cl.
USPC ..... 60/605.3; 60/321

(58) Field of Classification Search
USPC ..... 60/605.3, 320–323
See application file for complete search history.

(56) References Cited

U.S. PATENT DOCUMENTS

| | | | | |
|---|---|---|---|---|
| 3,948,052 | A * | 4/1976 | Merkle et al. | 60/605.1 |
| 4,147,467 | A | 4/1979 | Leicht et al. | |
| 4,364,717 | A | 12/1982 | Schippers et al. | |
| 4,583,367 | A * | 4/1986 | Kapfer et al. | 60/605.3 |
| 4,716,735 | A * | 1/1988 | Ruf et al. | 60/605.3 |
| 5,392,604 | A * | 2/1995 | Nikula et al. | 60/605.3 |
| 6,125,799 | A * | 10/2000 | Van Son et al. | 123/41.31 |
| 6,915,634 | B2 * | 7/2005 | Dumas et al. | 60/605.3 |
| 2002/0029570 | A1 | 3/2002 | Baeuerle et al. | |
| 2003/0015126 | A1 * | 1/2003 | Gokan | 114/55.5 |
| 2003/0017765 | A1 | 1/2003 | Gokan et al. | |
| 2004/0083730 | A1 * | 5/2004 | Wizgall et al. | 60/614 |
| 2010/0175374 | A1 * | 7/2010 | Steiner et al. | 60/598 |
| 2012/0067306 | A1 * | 3/2012 | Mehring et al. | 123/41.72 |
| 2012/0177476 | A1 * | 7/2012 | Jones | 415/1 |
| 2012/0192557 | A1 * | 8/2012 | Johnson et al. | 60/599 |

FOREIGN PATENT DOCUMENTS

| | | | |
|---|---|---|---|
| DE | 1217138 | B | 5/1966 |
| DE | 10025500 | A1 | 11/2001 |
| EP | 0781908 | A2 | 7/1997 |
| EP | 1577520 | A2 | 9/2005 |
| GB | 2126663 | A | 3/1984 |

* cited by examiner

*Primary Examiner* — Thomas Denion
*Assistant Examiner* — Patrick Maines
(74) *Attorney, Agent, or Firm* — Laurence A. Greenberg; Werner H. Stemer; Ralph E. Locher

(57) ABSTRACT

A turbocharger, especially a turbocharger for a motor vehicle, has a turbine housing and a bearing housing. The turbine housing and the bearing housing are fitted with a common cooling device. The turbine housing includes a flange for attaching to an exhaust gas manifold. The flange is formed with a coolant inlet, a coolant outlet, and an oil supply pipe.

11 Claims, 3 Drawing Sheets

TURBOCHARGER COMPRISING A COOLING DEVICE AND AN OIL SUPPLY PIPE

BACKGROUND OF THE INVENTION

Field of the Invention:

The invention relates to a turbocharger, in particular for a motor vehicle, which is provided with a cooling device for cooling the turbocharger housing and also has an oil supply pipe for providing lubricating oil.

Turbochargers generally comprise an exhaust gas turbine, which is arranged in an exhaust gas flow and is connected to a compressor in the intake tract by way of a turbo shaft. A turbine wheel and a compressor wheel are rotatably mounted here on the turbo shaft, with the turbine wheel being arranged in a turbine housing and the compressor wheel being arranged in a compressor housing. A bearing housing is arranged between the turbine housing and the compressor housing, in which bearing housing the turbo shaft is rotatably mounted. During operation, the exhaust gas flow, which is routed through an exhaust gas manifold into the turbine housing, drives the turbine wheel. The turbine wheel in turn drives the compressor wheel, as a result of which the compressor increases the pressure in the intake tract of the engine, so that a larger quantity of air reaches the cylinder during the intake cycle. This means that more oxygen is available and a correspondingly larger quantity of fuel can be burnt. As a result, the power output of the engine can be increased.

The cooling of hot exhaust gas turbocharger parts in combustion engines of road vehicles is known from the prior art. As a result of the high exhaust gas temperature of for instance automobile otto engines, which can amount to up to 1100° C., a significant temperature load on exhaust gas turbocharger components can result during full load or almost full load operation. In particular, the housing components are exposed to very high temperatures as a result of the poor cooling by means of convection. The temperatures of the exhaust gas-guiding components also have the tendency to increase further in the future, since the engines are charged continuously more and are thus loaded specifically higher.

According to the prior art, the materials for the housing parts of the turbine and manifold were designed for high temperatures from a resistance point of view. Nowadays this requires a high proportion of nickel in the material, since it is only then that casting materials can withstand the high temperatures. Nickel is a comparatively expensive raw material, which is also subject to significant world market fluctuations. It is for this reason also desirable to be able to dispense with nickel. Furthermore, the exhaust gas temperature of the engine is restricted by targeted fuel enrichment during full load. This is nevertheless disadvantageous in that the fuel consumption of the engine increases. Finally, the component temperature can only be restricted by limiting the engine performance. This is naturally not desirable. In the case of engines for use in marine applications, like for instance outboard motors, legal requirements relating to the maximum surface temperature exist. Exhaust gas-guiding surfaces may be heated to a maximum of 80° C. For this reason, a series of water-cooled turbine housings exist already for such applications.

DE 103 44 868 discloses an exhaust gas turbocharger for instance, which is defined for marine usage. This has a turbine housing, which is passed through by sea water as a cooling medium.

Furthermore, a turbocharger for marine usage is likewise known from DE 203 11 703. Here the turbocharger has a turbine housing, which is embodied with two walls and is cooled by means of sea water. Furthermore, the bearing housing of the turbocharger has an additional cooling device. Here the bearing housing is cooled using a coolant from a coolant circuit of a connected engine instead of using sea water.

BRIEF SUMMARY OF THE INVENTION

This object is achieved by a turbocharger having the claimed features.

This object is achieved by a turbocharger having the features of claim 1 and claim 2.

Accordingly, a turbocharger is provided in accordance with the invention, in particular for a motor vehicle: comprising

- a turbine housing and a bearing housing, with the turbine housing and the bearing housing being provided with a shared cooling device.

This is advantageous in that both housings can be cooled by way of a shared cooling device, for instance by means of cooling water from a cooling water circuit of an engine connected to the turbocharger. As a result, the turbocharger can provide greater boost for instance, without the turbocharger housing being heated excessively. A shared cooling device is also more cost-effective in terms of manufacture compared with separate cooling devices, such as are used in the previously cited marine applications. The turbine housing and the bearing housing each comprise a separate cooling device, with the turbine housing being cooled using sea water and the bearing housing being cooled using cooling water.

In accordance with the invention, a turbocharger, in particular for a motor vehicle, is also provided comprising:

- a turbine housing and a bearing housing,
- with the turbine housing and/or the bearing housing comprising a cooling device and
- with at least one oil supply pipe also being integrated into an exhaust gas manifold, the turbine housing and/or the bearing housing.

The turbocharger is advantageous here in that the turbine housing and/or the bearing housing is provided with a cooling system, so that the respective housing better withstands high temperatures, for instance during full load operation. The embodiment and/or the integration of the oil supply pipe into an exhaust gas manifold, the turbine housing and/or the bearing housing is advantageous in that no separate pipe has to be provided herefor. Furthermore, less vibration occurs with the integrated oil supply pipe. Furthermore, the lubricating oil in the oil supply pipe is heated more rapidly, for instance by means of the exhaust gas in the exhaust gas manifold and/or the turbine housing, so that the bearing can be better lubricated during the start-up phase.

Advantageous embodiments and developments of the invention result from the subclaims and the description with reference to the drawings.

According to one embodiment of the invention, the cooling device is integrated into an exhaust gas manifold, the turbine housing and/or the bearing housing. The integrated cooling device is advantageous in that no separate pipes are needed and the manufacture and assembly is thus more cost-effective. Furthermore, less vibration occurs in the integrated cooling device than in pipes routed separately fro m the turbocharger housing.

In a further inventive embodiment, the cooling device consists of at least one or several coolant supply pipes and/or at least one or several coolant drainage pipes. This is advantageous in that both the coolant supply and/or drainage can be integrated into the turbocharger housing and/or its exhaust gas manifold and as a result the installation of separate pipes can be dispensed with.

In another inventive embodiment, at least one oil supply pipe is also optionally provided, which is integrated into the exhaust gas manifold, the turbine housing and/or the bearing housing for instance. This is advantageous in that the oil supply pipe can also be heated by the exhaust gas-guiding components and an improved lubrication of the bearing of the turbo shaft is thus enabled in particular during the start-up phase.

According to a further inventive embodiment, the oil supply pipe is arranged in the vicinity of and/or adjacent to the coolant supply pipe and/or drainage pipe for instance. This is advantageous in that an excessive heating-up of the lubricating oil, for instance during full load operation, can be prevented by the lubricating oil being at least partially cooled by means of the cooling pipes.

According to a further inventive embodiment, the turbine housing, the exhaust gas manifold and/or the bearing housing has materials such as aluminum, gray cast iron, alloy-treated steels for instance. The cooling device also enables such less heat-resistant materials to be used.

In a further inventive embodiment, the exhaust manifold is embodied in one piece with at least one or several cylinder heads. This is advantageous in that manufacturing costs can be reduced. Alternatively, the exhaust gas manifold can also be embodied as a separate part.

According to another inventive embodiment, the exhaust gas manifold, the turbine housing and/or the bearing housing are embodied in one piece. This is advantageous in that no seal is needed for instance, as in the case of parts which are connected to one another separately. Alternatively, the parts can however also be embodied accordingly as separate parts.

The invention is described in more detail below with reference to the exemplary embodiments specified in the schematic figures of the drawing, in which;

DESCRIPTION OF THE INVENTION

Figure 1:
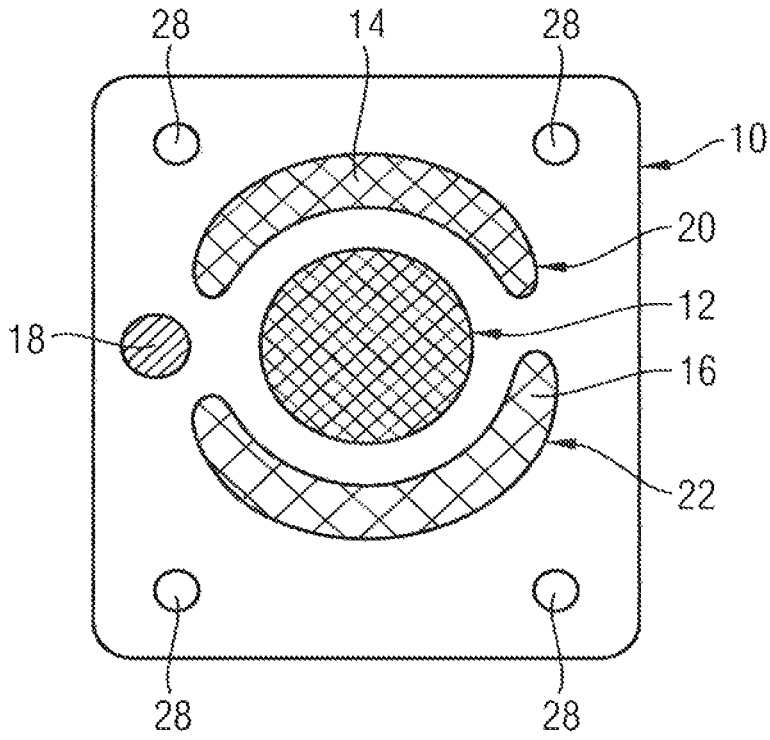
FIG. 1 shows a front view of a flange of an exhaust gas manifold of a turbocharger according to the invention.

FIG. 1 shows a front view of a flange 10 of an exhaust gas manifold of an inventive turbocharger (not shown). The exhaust gas manifold is attached with its flange 10 to a turbine housing of the turbocharger. A coolant inlet 154 is provided here around the exhaust gas manifold and/or its channel 12 guiding the exhaust gas in order to cool a turbine housing (not shown) and a bearing housing (not shown) of the turbocharger. Furthermore, a corresponding coolant outlet 16 is also provided on the exhaust gas manifold in order to recirculate the coolant after cooling the turbine housing and the bearing housing. Furthermore, an oil supply pipe 18 is also provided, with which lubricating oil is fed for lubricating the bearing in the bearing housing for instance.

The coolant, such as for instance cooling water, for cooling the turbocharger housing is removed here from a coolant circuit of an engine connected to the turbocharger. The coolant circuit (not shown) is formed here for instance from an engine block, a thermostat, a cooler and a coolant pump. After cooling the turbine housing and the bearing housing, the coolant can be fed back to the coolant circuit. The invention is however not restricted to this embodiment of a coolant circuit. The afore-cited coolant circuit is only exemplary in order to explain the principle of the invention.

The embodiment of a coolant supply pipe and drainage pipe 20, 22, and an oil supply pipe 18 to the exhaust gas manifold is advantageous in that separate pipes do not have to be provided and/or routed herefor as in the prior art, but instead the exhaust gas manifold is formed simply with corresponding pipes and/or these are integrated therein. The turbine housing and the bearing housing here comprise at least one section, which is embodied with two walls in order to convey the coolant therethrough and at least one section, in order finally to recirculate the coolant back into the coolant circuit. The respective section is provided here such that it is large enough to surround a corresponding region of the turbine housing and/or bearing housing which is to be cooled. Basically, several sections can however also be provided for supplying and/or draining the coolant. Here the exhaust gas manifold is embodied with its cooling pipes and the oil supply pipe accordingly so that the exhaust gas manifold can be connected accordingly to the turbine housing.

The cooling of the turbine housing and the bearing housing is advantageous in that both housings, and the exhaust gas manifold, can also be manufactured from less heat-resistant materials. For instance, the respective housing can comprise materials such as aluminum, alloy-treated steel, gray cast iron etc. It is therefore possible for instance to dispense with the use of nickel or the proportion thereof can at least be reduced. This is also advantageous in that manufacturing costs can be reduced.

Furthermore, the cooling of the turbine housing and the exhaust gas manifold connected to the turbine housing ensures that the exhaust gas-guiding components are not heated too significantly, particularly during full load and/or near full load operation. Furthermore, the turbocharger can herewith also be charged more significantly since it can better withstand the significant temperature loads developing. A further advantage is that as a result of the additional cooling of the bearing housing the bearing in the bearing housing cannot so readily overheat.

The arrangement of the oil supply pipe 18 on the exhaust gas manifold for supplying lubricating means to the bearings of the bearing housing is in turn advantageous in that the lubricating in the exhaust gas manifold oil is heated more quickly by the hot exhaust gas in the start phase of the motor vehicle for instance and an improved lubrication of the bearing, for instance the turbo shaft, can as a result be provided in this phase. Furthermore, the oil supply pipe 18 can also be arranged in the vicinity of and/or adjacent to the coolant supply pipe 20 and/or the coolant drainage pipe 22 on the exhaust gas manifold, so that the lubricating oil is not excessively heated during full load and/or near full load operation for instance.

Furthermore, the inventive turbocharger provides for a defined interface, for the coolant pipes 20, 22 and the oil supply pipe 18. As can be inferred from FIG. 1, the exhaust gas manifold with the coolant inlet and outlet 14, 15, and the oil supply pipe 18 is attached, for instance screwed, directly to the turbine housing in the form of the flange 10 for instance. To this end, the flange 10 comprises corresponding openings 28 for the through-guidance of screws. On the other hand, the exhaust gas manifold is connected for instance in one piece with assigned cylinder heads of an engine, as shown in more detail in FIG. 2. The exhaust gas manifold can however also be embodied as a separate part, which is connected to the cylinder heads.

The exhaust gas manifold can be connected to the coolant circuit and the oil supply pipe of the engine for instance. This is advantageous in that no separate coolant circuit has to be set up, but instead an existing coolant circuit can be used. An extra coolant circuit can however basically be provided to cool the exhaust gas manifold and the turbocharger housing.

The oil drain itself remains in the bearing housing for instance. Furthermore, as mentioned previously, it is not only the turbine housing which is provided with a cooling system and/or a cooling jacket but also the bearing housing.

The bearing housing can be embodied here as integrated into the turbine housing. The turbine housing and the bearing housing can essentially be embodied in one piece. This is advantageous in that no seal is needed between the cooling pipes and the oil supply pipe, as is the case with separate housings.

With two separate housings, the bearing housing likewise comprises for instance a corresponding coolant supply pipe and a coolant drainage pipe, with the coolant pipes of the bearing housing connecting to the corresponding coolant pipes of the turbine housing. The transition between the turbine housing and the bearing housing is preferably provided here with a corresponding seal, so that coolant cannot escape unintentionally.

The same also applies to the oil supply pipe 18. The oil supply pipe 18 embodied on the exhaust gas manifold is connected to a corresponding extension of the oil supply pipe in the turbine housing and/or the bearing housing, with a suitable sealing device being provided between the turbine housing and the bearing housing and the exhaust gas manifold and the turbine housing, if the housing and/or the manifold are embodied as separate parts. The lubricating oil for lubricating bearings of the bearing housing is drained off via the oil drain (not shown) present in the bearing housing, in the oil sump of the engine for instance.

The invention relates to the combination of a combustion engine with an exhaust gas manifold integrated into the cylinder head for instance and a water-cooled turbine housing with an integrated bearing housing made of aluminum for instance. Particular attention is paid here to a corresponding interface for the water supply and the oil pressure supply of the exhaust gas turbocharger. In accordance with the invention, the interface between the engine (outlet channel exhaust gas) and the exhaust gas turbocharger (input turbine housing) is embodied such that both the cooling medium, here water, can flow to and fro and also the pressure oil for the oil pressure supply can flow into the exhaust gas turbocharger. The recirculation of the pressure oil takes place by way of a pipe from the bearing housing of the exhaust gas turbocharger directly into the oil sump.

The inventive steps lies on the one hand in the combination of the turbine housing and the bearing housing, for instance made of aluminum, with an integrated guide of coolant and pressure oil and on the other hand in the interface between the engine and the exhaust gas turbocharger, to which not only the coolant for the exhaust gas turbocharger is guided to and fro, but instead also the pressure oil is fed for the pressure oil supply of the bearings of the turbocharger.

Figure 2:
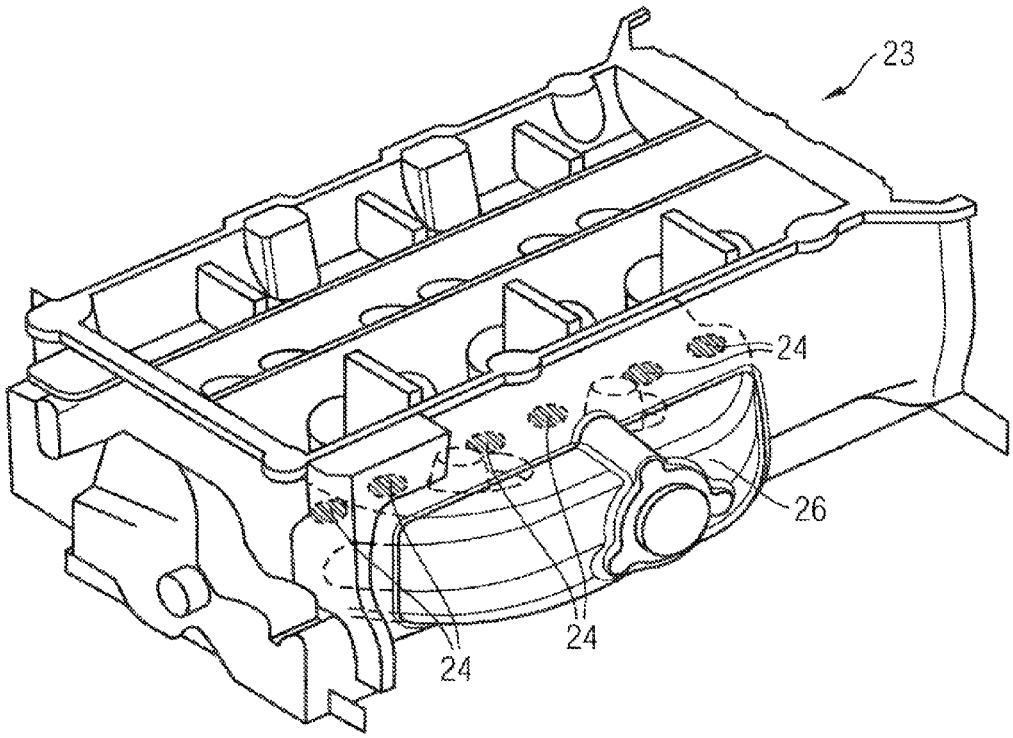
FIG. 2 shows a perspective view of an engine block, with cylinder heads of the engine block being provided with an integrated exhaust gas manifold.

FIG. 2 shows a perspective view of an engine block 23. The cylinder heads 24 of the engine block 23 are embodied here for instance with an integrated exhaust gas manifold 26. The arrangement of the cooling pipes and the oil supply to the exhaust gas manifold 26 is not shown here for reasons of clarity.

Accordingly, a turbine housing and a bearing housing can be connected to the exhaust gas manifold 26 or embodied so as to be integrated herewith. Here the turbine housing and the bearing housing can be attached to the exhaust gas manifold by way of a corresponding flange connection, as shown in FIG. 1, or embodied in one piece herewith. Basically, the turbine housing and the exhaust gas manifold can however also only be embodied in one piece for instance.

Furthermore, as was described previously, the turbine housing and the bearing housing can be embodied in one piece or as separate parts for instance. The integrated embodiments, as were described previously, are advantageous in that they are simple to manufacture and also dispense with the need for seals, which are otherwise needed in order to connect the individual housing.

Although the present invention was described with reference to preferred exemplary embodiments, it is not restricted hereto but can be modified in a variety of ways. The afore-cited embodiments can be combined with one another, in particular individual features thereof.

It is basically possible with the afore-cited embodiments for only the turbine housing or the bearing housing to be cooled for instance. Furthermore, the provision of the oil supply can optionally be provided in addition or alternatively to the cooling device on the exhaust gas manifold, the turbocharger housing and/or the bearing housing. In the embodiments, a separate oil supply can also be provided for instance. The same also applies to the coolant drainage pipe. Basically this can likewise be provided as a separate pipe, which is not integrated into the exhaust gas manifold and/or the turbine housing and the bearing housing contrary to the coolant supply pipe.

Figure 3:
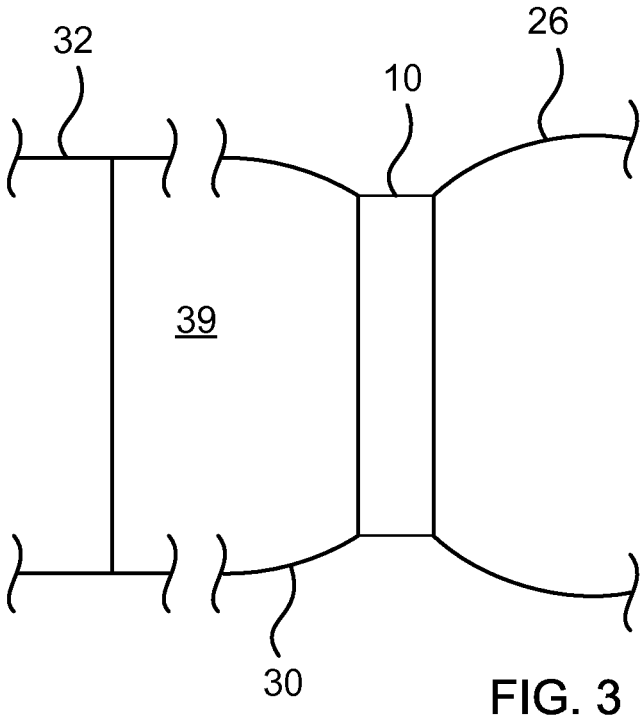
FIG. 3 shows a highly diagrammatic view of an exhaust gas manifold connected to a turbine housing by a flange.

FIG. 3 shows a highly diagrammatic view of an exhaust gas manifold 26 connected to a turbine housing 30 by a flange 10. A bearing housing 32 can also be seen.

The invention claimed is:

1. A turbocharger, comprising:

a turbine housing and a bearing housing;

said turbine housing having a cooling device and having at least one oil supply pipe integrated into said turbine housing; and said turbine housing including a flange for attachment to an exhaust gas manifold, said flange being formed with a coolant inlet, a coolant outlet, and an oil supply pipe.

2. The turbocharger according to claim 1, wherein the exhaust gas manifold and one or a plurality of cylinder heads of the engine are integrally formed in one piece.

3. The turbocharger according to claim 1, wherein the exhaust gas manifold and cylinder heads of the engine are formed as separate parts.

4. The turbocharger according to claim 1, wherein the exhaust gas manifold and at least one of said turbine housing and said bearing housing are formed as separate parts.

5. The turbocharger according to claim 1, wherein said cooling device is integrated into said turbine housing and said bearing housing, and/or in the exhaust gas manifold.

6. The turbocharger according to claim 1, wherein said oil supply pipe is integrated into said turbine housing and said bearing housing, and/or in the exhaust gas manifold.

7. The turbocharger according to claim 1, wherein said cooling device includes at least one pipe selected from the group consisting of a coolant supply pipe and a coolant drainage pipe.

8. The turbocharger according to claim 7, wherein said oil supply pipe is adjacent at least one pipe selected from the group consisting of said coolant supply pipe and said coolant drainage pipe.

9. The turbocharger according to claim 1, wherein said turbine housing, said exhaust gas manifold, and said bearing housing are formed of materials selected from the group consisting of aluminum, gray cast iron, and alloy-treated steel.

10. The turbocharger according to claim 1 configured for a motor vehicle with an internal combustion engine.

11. A motor vehicle, comprising a turbocharger according to claim 1.

* * * * *